United States Patent [19]

Stocker

[11] 4,223,882

[45] Sep. 23, 1980

[54] AUTOMATED IN-LINE MAILING SYSTEM

[75] Inventor: Lester H. Stocker, Phillipsburg, N.J.

[73] Assignee: Bell & Howell Company, Phillipsburg, N.J.

[21] Appl. No.: 910,315

[22] Filed: May 26, 1978

[51] Int. Cl.[3] ..... B41F 13/56

[52] U.S. Cl. ..... 270/21; 270/45; 53/435; 53/520; 83/209; 83/371

[58] Field of Search ..... 270/21, 37, 45–51, 270/53, 58; 53/237, 447, 435, 460, 474, 520; 83/371, 210, 209

[56] References Cited

U.S. PATENT DOCUMENTS

| | | | |
|---|---|---|---|
| 3,751,874 | 8/1973 | Schultes | 53/520 |
| 3,897,051 | 7/1975 | Muller | 270/21 |
| 3,983,679 | 10/1976 | Zemke | 53/435 |
| 4,034,973 | 7/1977 | Hams | 270/21 |

*Primary Examiner*—Edgar S. Burr
*Assistant Examiner*—A. Heinz
*Attorney, Agent, or Firm*—Griffin, Branigan & Butler

[57] ABSTRACT

An automated in-line mailing (AIM) system of the type comprising sequentially a continuous sheet-web (20), a sheet cutter (10), an accumulator (12), a folder (14), a collector (16) and an envelope inserter raceway (24) is controlled by hyphens, or indicia, (60) on the sheet web (20). A control system includes a scanner (56) for sequentially sensing the web indicia (60) upstream of a cutting blade (30). The scanner is linked to a one-way clutch drive (114) to activate a plurality of opposed mutilated rollers (88, 90) positioned in the accumulator (12). The control system also includes a trailing edge sensor (122) for sensing a trailing edge of an accumulation of sheets as they are discharged from the accumulator (12). The control system senses when a set of sheets has been cut by the cutter (10) and, in response thereto, deenergizes the cutter (10) with a first sheet of a following set extending beyond a cutter blade of the cutter (10) and energizes the accumulator (12) to eject the completed set into the folder (14) to be folded as a unit and deposited with the collector (16). Once the collector has collected a group of sets it is ordered by the control system to dump them on the inserter raceway (24).

11 Claims, 6 Drawing Figures

FIG. 2
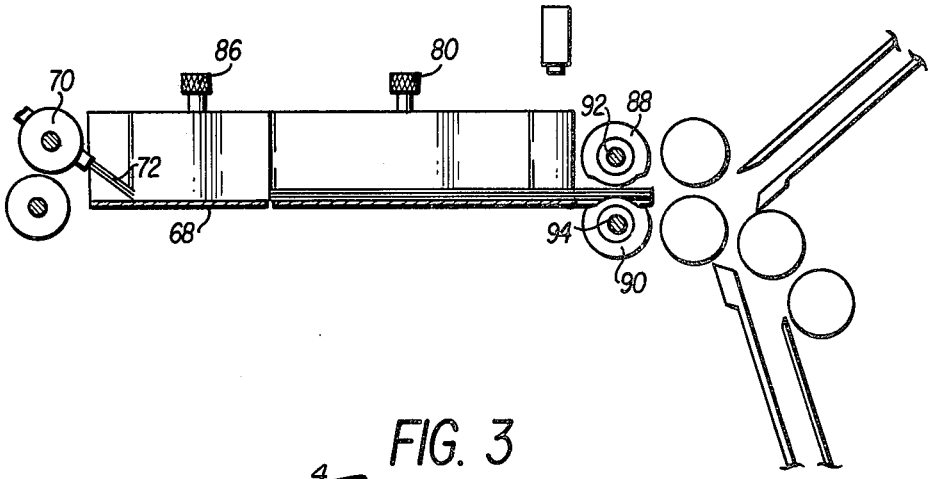
FIG. 3
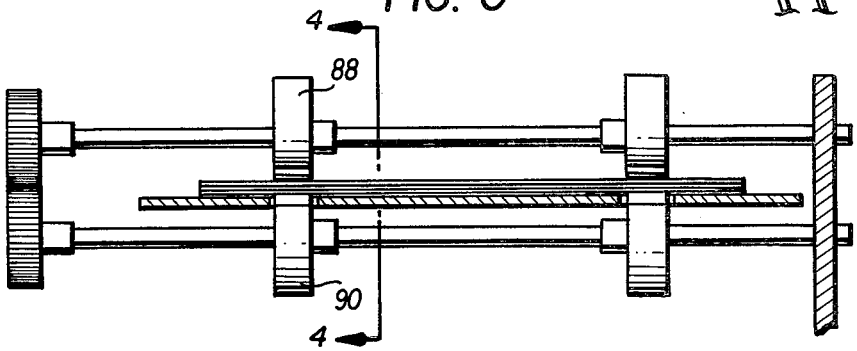
FIG. 4a
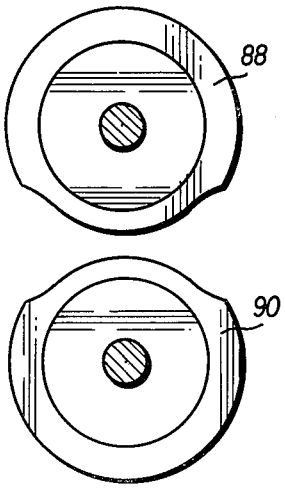
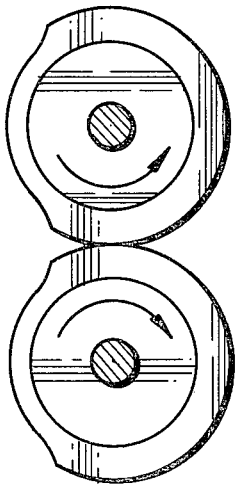
FIG. 4b

AUTOMATED IN-LINE MAILING SYSTEM

BACKGROUND OF THE INVENTION

This invention relates generally to the art of sheet handling machines, and more specifically to such machines for preparing mass mailings.

Automated in-line mailing (AIM) systems have been designed including cutters, register tables, folders, collectors, and inserters. Sometimes, in such a system the cutter receives a preprinted sheet web which it cuts into individual sheets. These sheets are sequentially, automatically, fed to the register table which straightens and feeds them to a folder. The folder, in turn, folds the sheets into appropriate sizes and feeds them to a collector which collects the folded sheets until a set corresponding to one letter is collected. The collector then ejects, or "dumps" the set, or letter, onto an insert raceway which moves the letter through insert stations. Appropriate inserts are deposited at the insert stations onto the letter. Thereafter, the inserts and letter are stuffed into an envelope which is closed for mailing.

Using indicia printed on the margins of the preprinted sheet web to control the operation of various elements of an above-described AIM system is taught in Hams U.S. Pat. No. (4,034,973). A characteristic of this AIM system, however, is that it folds individual sheets prior to collecting them, thus the sheets of multipage letters are not folded together.

Thus, it is an object of this invention to provide an AIM system which folds the sheets of multipage letters or sets, together, even when the numbers of sheets for successive sets vary. Similarly, it is an object of this invention to provide such an AIM system which allows the collection of a group of folded sets.

It is also an object of this invention to provide an effective control system and accumulating mechanism for handling varying quantities of sheets as they are received from the cutter and delivered to the folder for such an AIM system.

A difficulty with some prior-art AIM systems is that when cutters thereof are reactivated for cutting a next set, sufficient sheet web must first be fed past a cutting element thereof, thereby taking an undue amount of time.

It is therefor a further object of this invention to provide such a control system for an AIM system which is relatively fast, reliable but yet uncomplicated.

SUMMARY OF THE INVENTION

According to principles of this invention, a control system for controlling the flow of sheets through an AIM system fully integrates operations of a cutter, an accumulator, a folder, and an inserter. The control system includes a scanner for sequentially reading a column of indicia on a supplied web upstream of a blade of the cutter. The information received by the scanner and passed to the control system controls the number of sheets accumulated in the accumulator and the subsequent ejection of the accumulated sheets to the folder for folding them into a single letter. The distance between the cutter and folder is adjustable and the accumulator forms a transition therebetween. In this respect, the accumulator has an expandable bottom plate with adjustable edge guides, so that is can be adjusted to handle various size sheets. The accumulator also includes opposing mutilated rollers and a trailing edge sensor at its discharge end. The trailing edge sensor is linked to the control system and to a web and cutter drive.

Information from the indicia on the web is supplied by the scanner to the control system which provides command signals to a one-way clutch which, in turn, activates the mutilated rollers at proper times to discharge accumulated sets of sheets from the accumulator and feed them to the folder for folding them ino a single letter. As the trailing edge of each set of accumulated sheets leaves the accumulator, the trailing edge sensor sends a signal to the control system to activate the web and cutter to proceed with cutting the next individual sheet or set of individual sheets. The folder, upon completion of folding the sets of sheets into single letters, discharges the folded letters into a collector which, in turn, dumps groups of folded sets onto an insert raceway. The control system deactivates the cutter with a first sheet of a following set extending beyond a cutter blade in order to save time when the cutter is reactivated.

In a "two-up" embodiment of this invention, the cutter slits the web down the middle as well as cutting it into sheets, so that side-by-side sheets are produced. These sheets travel along parallel channels through the accumulator, the folder and the collector. In turn, the collector dumps the folded letters onto an insert raceway.

BRIEF DESCRIPTION OF THE DRAWINGS

The foregoing and other objects, features, and advantages of the invention will be apparent from the following more specific description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 2 is a fragmented sectional view of the AIM system taken on line 2—2 of FIG. 1;

FIG. 3 is a fragmented sectional view of the AIM system taken on line 3—3 of FIG. 1; and FIGS. 4*a* and 4*b* are enlarged sectional views taken on line 4—4 in FIG. 3 at different time intervals in a sequence of operations.

DESCRIPTION OF THE PREFERRED EMBODIMENTS

Figure 1:
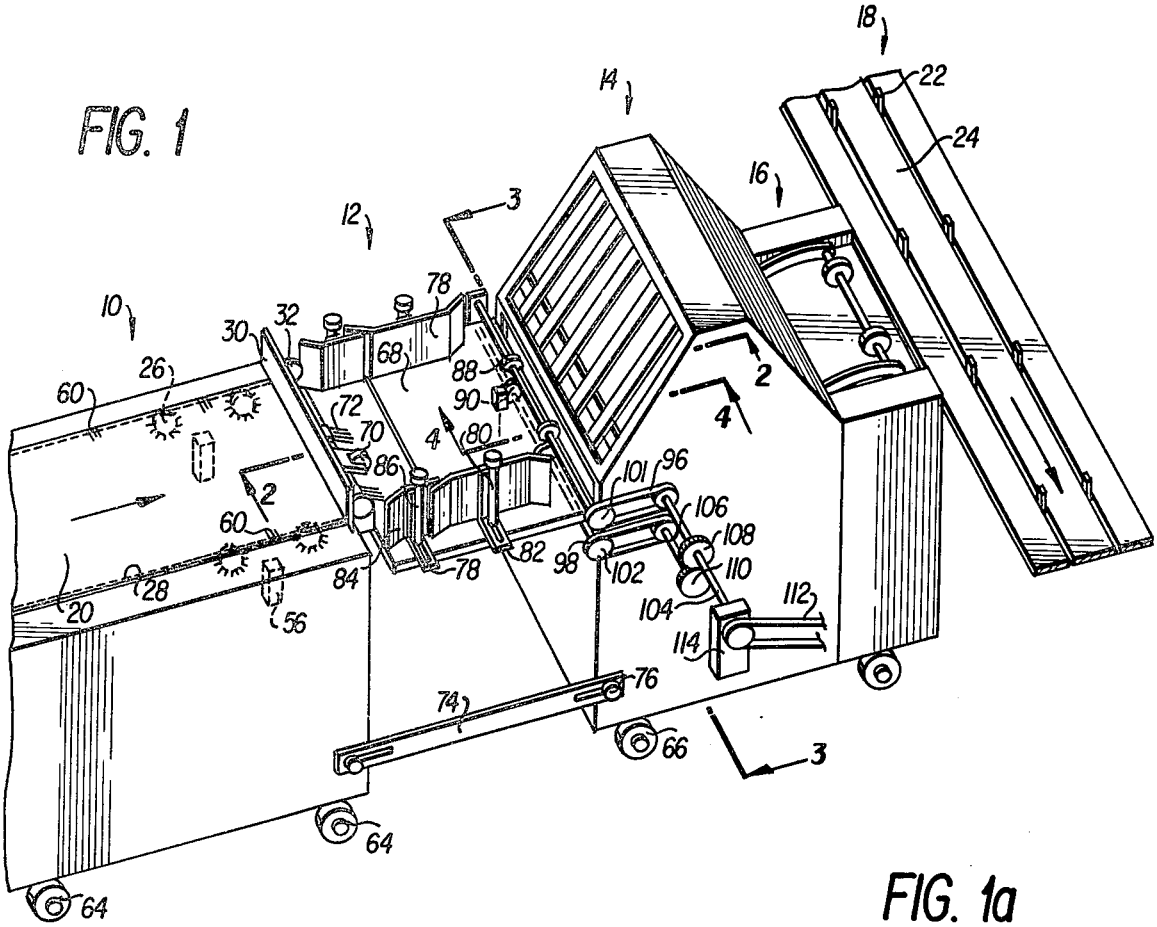
FIG. 1 is a simplified, isometric, partially-schematic, diagram of an AIM system employing principles of this invention.
Figure 1A:
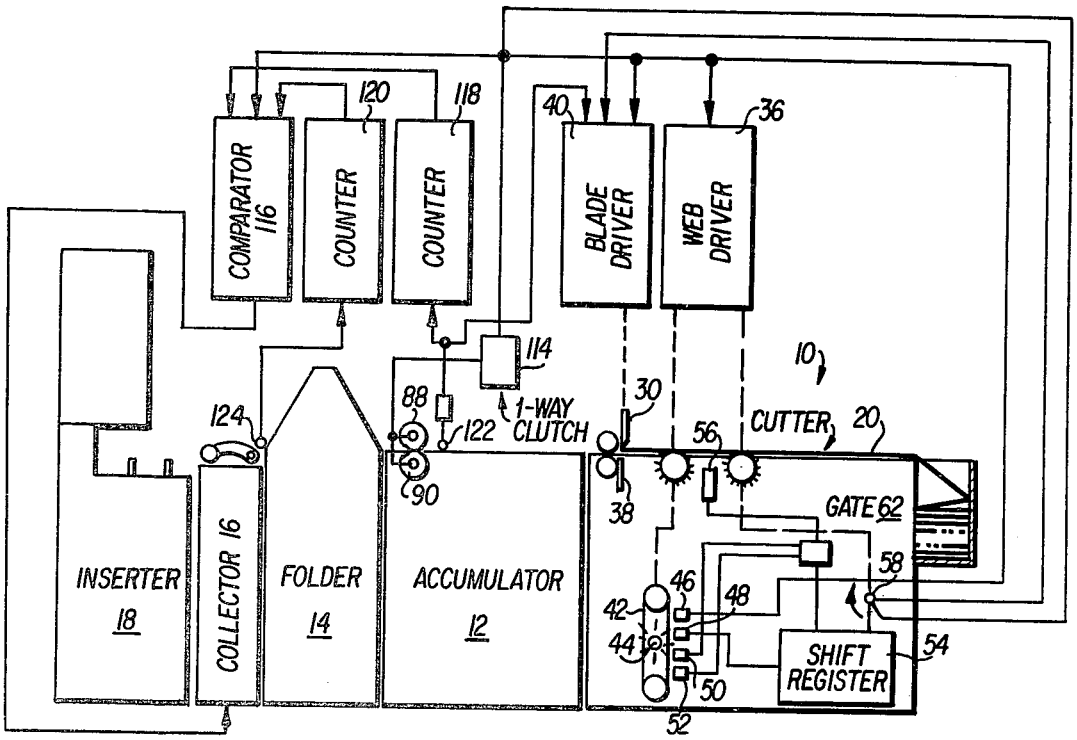
FIG. 1*a* is a schematic diagram of the system of FIG. 1.

An AIM (automatic in-line mailing) system of this invention comprises a FIMA sheet-web cutter 10, an accumulator 12, a continuously running buckle folder 14, a collector 16, and an inserter 18.

The general operation of the AIM system of FIG. 1 is that the FIMA sheet-web cutter 10 cuts a sheet-web 20 into individual sheets which are deposited in a pile onto the accumulator 12 until a set (such as a letter) is accumulated thereon. The accumulator then ejects the sheet pile into the buckle folder 14 which folds the pile into letter size and deposits it with the collector 16. The collector 16, once it has received a proper number of folded piles, and once inserter raceway pins 22 are in appropriate positions, dumps a collected group of folded piles onto the raceway 24 of the inserter 18.

The sheet-web cutter 10 is described in more detail in U.S. Pat. No. 4,034,973 to Hams, and that description is incorporated herein by reference. Basically, the sheet-web cutter includes toothed wheels 26 which mesh with apertures 28 in the margins of the web 20 to drive the web 20 toward a laterally cutting blade 30. The laterally cutting blade 30 is reciprocally driven down and up in cooperation with a stationary blade 38 to cut sheets from the sheet-web 20. Rotary side slitting blades 32 slit away margins of the web 20 which contain the apertures 28 and indicia to be described below. The toothed wheels 26 are driven by a web driver 36 to drive the sheet-web 20 toward the laterally cutting blade 30. The laterally cutting blade 30 is reciprocally driven up and down in cooperation with the stationary blade 38 by a blade driver 40 to cut sheets from the sheet-web 20.

The sheet-web cutter 10 of FIGS. 1 and 2 also include an endless indexing tape 42 which is disclosed in detail in U.S. Pat. No. 4,034,973. The indexing tape 42 is used to actuate the web driver 36 and the blade driver 40. In this respect, the indexing tape 42 has holes positioned along a longitudinal track thereof which corresponds to lateral cuts to be made by the laterally-cutting blade 30. A light source 44 is located on one side of the indexing tape 42 and a light sensor 46 is positioned adjacent to the light source 44 on the other side of the indexing tape 42. When a hole is between the light source 44 and the light receiver 46, the light receiver is activated to provide a signal to the web driver 36 and the blade driver 40 to thereby stop the web driver 36, activate the laterally cutting blade 30 to cut a sheet from the sheet-web 23 of the predetermined length, and restart the web driver. In this regard, a photocell (not shown) senses the completion of the cut sequence to initiate a new feed.

In the preferred embodiment of this invention, three additional tracks, or channels, of holes (not shown) are added to the index tape 42 and three additional light receivers 48, 50, and 52 are positioned on the opposite side of the indexing tape 42 from the light source 44 adjacent respectively to holes in the three additional tracks. The output from the light receiver 48 is used as a clock signal source to drive a cutter shift register 54. The cutter shift register 54 receives data from a light scanner 56 which is located adjacent to the sheet-web 20 upstream of the laterally cutting blade 30 and provides output data at a sampler 58. The output data detected by the sampler 58 is used to inhibit starting of the blade driver 40 once it is ready for a cut. In this regard, indicia, or hyphens, 60 (FIG. 1) are positioned, or not positioned, in a column on that portion of the sheet-web 20 corresponding to the first page of a letter, or set, so as to pass over the light scanner 56 and be thereby read, or not read, by the light scanner 56. The positions of the hyphens 60 are synchronized with read holes, which are detected by light receiver 52, to enable a gate 62 so that the information from the hyphen is fed into the cutter shift register 54 as it passes over the light scanner 56. Other holes on the tape 42 activate the light receiver 50 to "disable" the gate 62 to prevent false mark signals from being used.

Describing next the accumulator 12, broadly, the purpose of the accumulator 12 is to receive cut sheets from the web cutter 10, accumulate a group of these sheets, and eject this group, as a unit, to the buckle folder 14 to be folded together.

With reference to FIG. 1, it can be seen that the cutter 10 and the folder 14 are on rollers 64 and 66 respectively. Thus, these machines can be moved relative to one another by rolling them on these rollers. The accumulator 12 forms an interface between the cutter 10 and the folder 14. In this respect, the accumulator 12 comprises an insert plate 68 which is tap-screw fastened to a frame of the cutter 10 at one end and to the folder 14 at the other end. Mounted on the insert plate 68 at the cutter end thereof is a structure for supporting a feed roller 70 and deflector brushes 72. The roller 70 and the deflector brushes 72 control the web 20 as it is conveyed beyond the laterally cutting blade 30 to urge it downwardly toward the insert plate 68. In this respect, the exit of the cutter 10 is higher than the insert plate 68 such that the web 20 must move downwardly upon exiting from the cutter 10 to contact the insert plate 68. The insert plate 68, itself, is a telescoping structure which allows the cutter 10 and the inserter 14 to be moved toward one another to accommodate eight inch sheets, for example, and away from one another to accommodate eleven inch sheets. Other size sheets could also be thereby accommodated. In this respect, side adjustment brackets 74, in combination with bolts 76, also allow such adjustment and provide for fixing the machines relative to one another once an adjustment has been made.

Main edge guides 78 are mounted vertically on opposite sides of the insert plate 68 and are held in position thereon by edge guide posts 80 which are screwed into the insert plate 68 through slots in edge guide brackets 82. When the cutter 10 and the folder 14 are separated sufficiently far so as to telescope the insert plate 68 outwardly, auxiliary edge guides 84 are attached to the insert plate 68 by auxiliary edge guide posts 86 at the ends of the main edge guides 78.

Mounted at the folder end of the insert plate 68, preferrably onto a part of a frame of the folder 14, is a mutilated roller system including upper and lower mutilated rollers 88 and 90. The upper and lower mutilated rollers 88 and 90 are respectively mounted on shafts 92 and 94 which are respectively driven by chains 96 and 98 via sprockets 101 and 102 fixedly mounted on the upper and lower shafts 92 and 94. The chains 96 and 98 are driven by a main driveshaft 104 and an auxiliary driveshaft 106 which are coupled together by gears 108 and 110. The main driveshaft 104 is driven by a chain 112 through a one-way clutch 114. The upper and the lower mutilated rollers 88 and 90 are shown in their home position in FIG. 4*a*. In this position, sheets which are deposited with the accumulator 12 from the cutter 10 slide between the mutilated rollers. However, once the accumulator 12 is full, an energizing signal is applied to the one-way clutch 114 to transmit energy from the continually operating chain 112 to the main driveshaft 104 to thereby rotate the mutilated rollers 88 and 90 one revolution as is shown in FIG. 4*b*. When this is done, a sheet group positioned between the mutilated rollers is pinched therebetween and ejected to the folder 14.

With regard to the folder 14, this folder is a buckle folder of a type well known in the art (see U.S. Pat. No. 3,856,293 to Boyer for example).

The collector 16 at the exit of the buckle folder 14 is of the type that is fully described in U.S. Pat. No. 4,078,790 to Stocker.

The inserter 18 is sufficiently described in U.S. Pat. No. 4,034,973 to Hams and further description is not necessary here.

Turning next to the overall control system of the AIM system disclosed herein, this control system is somewhat similar to the control system of U.S. Pat. No. 4,034,973, however, it is modified therefrom. In this respect, as was mentioned above, the sampler 58 transmits an inhibit signal to the blade driver 40 indicating that a first sheet of a group of sheets to be folded together is at the laterally cutting blade 30. This signal is also applied to a comparator 116. The comparator 116 receives input signals from counters 118 and 120. The counter 118 counts the groups of sheets which are fed from the accumulator 12 by mutilated rollers 88 and 90 and the counter 120 counts the folded groups when they arrive at the collector 16. In this respect, the counter 118 is connected to a trailing-edge sensor 122 which is a photosensor (either reflective type or a sendor/receiver type) to detect the trailing edges of the groups when they are sent by the accumulator, and the counter 120 is attached to another photosensor 124 to detect the folded groups of sheets when they arrive at the collector 16. The signal from the trailing-edge sensor 122 is also fed to the blade driver 40.

In operation, a forward edge of the sheet-web 20 is fed beyond the laterally cutting blade 30 by the toothed wheels 26. The light scanner 56 scans the column on the sheet-web 20 where indicia, or hyphens, 60 appear. When the first page of a letter set passes over the light scanner 56, the hyphens on that page are read in sequence by the light scanner 56, and as they are read they are clocked into the cutter shift register 54 by clock signals from the light receiver 48. Only the first page of each letter set has hyphen indicia thereon. As each sheet on the sheet-web 20 reaches the laterally cutting blade 30, the web driver 25 is stopped in response to a signal from the light receiver 46 and a cut is made by the laterally cutting blade 30. At the same time, the sampler 58 samples the stage of the cutter shift register 54 which is, or is not, holding data at that point to further inhibit, or not inhibit, the blade driver 40 from further operation. If the sampler 58 detects an inhibit signal, it will inhibit the blade driver the next time the blade driver is ordered to make a cut and the blade drive will, therefore, not make the next cut. However, the web driver will continue to drive a web until a sheet-length piece of web is beyond the laterally cutting blade 30. For example, assuming the "blade-driver-inhibit" information is contained in a hyphen which is detected by the light scanner 56, shifted to the sampler 58 in the shift register 54, and transmitted by the sampler 58 to the blade driver 40. This indicates to the blade driver 40 that the first page of a letter set is at the laterally cutting blade 30 and tells the blade driver 40 not to cut the next time it is ordered to do so by the light sensor 46. However, the web driver 36 does drive the first page of the letter past the laterally cutting blade 30 before stopping to leave a first sheet ready to be cut once the blade driver 40 makes its cut as is described below.

A signal from the sampler 58, is also fed to the one-way clutch 114 at the accumulator 12 to rotate the mutilated rollers 88 and 90, 360 degrees and thereby eject a set of sheets that is positioned between the mutilated rollers for the previous letter set. This letter set is picked up by rollers in the folder 14 and transported until its trailing edge clears the trailing-edge sensor 122 in the accumulator. The trailing-edge sensor 122 sends a pulse to the counter 118 and to the blade driver 40 ordering the blade driver 40 to make the cut from which it was inhibited previously. Once the blade driver 40 makes this cut, a blade sensor (not shown) starts up the web driver 36 and the cycle is repeated until the hyphens of a new first page of a letter set is detected by the scanner 56, at which time the cycle is repeated.

The buckle folder 14 operates continuously and, when it receives a set of sheets from the accumulator 12, it folds the set together and deposits it with the collector 16 where the set is counted by the counter 120. At this point, the comparator 116 realizes that the counts on the counters 118 and 120 are equal. The comparator 116 also receives a separate control signal from the sampler 58 which tells the comparator that this is the last of a group of sets, if it is the last, the comparator knows that it can then order the collector 16 to "dump" a group of sets that has been collected by the collector 16 onto the inserter 18. Upon the blade driver 40 cutting the last sheet of a group of sets, it is inhibited from further cutting until the collector 16 dumps (the control means for providing this function is not shown, but the mechanism is similar to that used in U.S. Pat. No. 4,034,973 to Hams.)

With particular regard to the accumulator 12, other than the edge guides 78 and 80, the accumulator has very little registering ability, but the sheets are already registered when they are received from the cutter 10.

It will be appreciated by those skilled in the art that the AIM system described herein has the ability to accumulate various numbers of sheets into a set which can be folded together. Also, this system allows the collection of folded sets into a group.

Further, this system is faster than prior art systems in that it provides for feeding the first sheet of a set past the lateral cutting blade 30 prior to inhibiting further action of the cutter blade and the web driver. Thus, when the cutter 10 is again actuated by receipt of a signal from the trailing edge sensor 122 the system can start by cutting a first sheet of the next set without feeding.

While the invention has been particularly shown and described with reference to a preferred embodiment, it will be understood by those skilled in the art that various changes in form and detail may be made therein without departing from the spirit and scope of the invention. For example, a "two-up" mode of operation would be allowed by slitting the web 20 longitudinally as it passes through the cutter 10, thus allowing two sheets to follow parallel paths through the accumulator 12, the folder 14, and the collector 16. In this case, a central, thin, edge guide would be required in the accumulator and additional control features would be required.

The embodiments of the invention in which an exclusive property or privilege is claimed are defined as follows:

1. An automated in-line mailing system including:

a web supply means for supplying a sheet-web having control indicia thereon;

a cutter means attached to said web-supply means for receiving said sheet-web and cutting said sheet-web into individual sheets with a cutting element, said cutter means including a driving means for driving said sheet-web;

an accumulator means for successively receiving individual sheets from said cutter means, successively accumulating individual sheets into sheet piles containing various numbers of individual sheets, and, upon receiving command signals, successively feeding said piles having various numbers of individual sheets into a folding means;

a folding means for receiving sheet piles from said accumulator means and for folding said piles;

a collector means for receiving folded piles of sheets from said folding means, collecting said folded piles of sheets into a group of piles, and thereafter depositing said piles with a receiving means; and a control system therefor including a scanner for reading said control indicia on said sheet-web, said control system being coupled to said accumulator means for providing said command signals to said accumulator means to eject a pile of individual sheets in response to said scanner reading a control indicia on said sheet web.

2. An automated in-line mailing system as in claim 1 wherein said scanner is positioned upstream of said cutting element.

3. An automated in-line mailing system as in claim 2 wherein said control system is further coupled to said cutter means for deactivating said cutter means in response to a signal read by said scanner from said sheet-web.

4. An automated in-line mailing system as in claim 3 wherein said control system deactivates said cutter when a first sheet of a set to be cut extends beyond said cutting element, but is not yet cut.

5. An automated in-line mailing system as in claim 3 or 4 wherein said control system further comprises a sensor for sensing ejection of a sheet pile from said accumulator means and wherein said control system reactivates the cutter means in response to said accumulator means' ejection thereof.

6. An automated in-line mailing system as in claim 5 wherein said ejection sensor senses the trailing edge of said sheet pile.

7. An automated in-line sheet processing system including:

a webb supply means for supplying a sheet-web to travel along a sheet web path;

a cutter system having a cutting element for moving into said sheet web path and thereby cutting said sheet web into individual sheets, said cutter system including a drive means for receiving said sheet-web from said web supply means and driving said sheet-web along said sheet web path past said cutting element;

an accumulator means for receiving individual sheets from said cutter means, accumulating varying quantities of said individual sheets into sets, and, upon receiving command signals, successively ejecting said sets;

further sheet processing means for receiving said sheet sets from said accumulator means and further processing said sheet sets;

a control-system means coupled to said cutter system and said accumulator means for sensing when said cutter has cut the last individual sheet of a firstly-cut set of sheets to be accumulated by said accumulator and, in response thereto, controlling said drive means to thereafter drive said sheet web to extend a portion thereof a distance corresponding to a first sheet of a secondly-cut set past said cutting element, but then to deactivate said cutter system such that said drive means and said cutting element leave said extended portion, uncut, in this position, until said control system means senses a further condition of said firstly-cut set, said control system thereafter sensing a processing step related to the location of said firstly-cut set and, in response thereto, reactivating said cutter system such that said cutting element immediately cuts off said sheet-length extended portion to form the first sheet of the secondly-cut set and said cutting element and said drive means thereafter sequentially drive the sheet web and cut individual sheets therefrom for the secondly-cut set.

8. An automated in-line sheet processing system as in claim 7 wherein said further sheet processing means comprises a folder.

9. An automated in-line sheet processing system as in claim 7 or 8 wherein said control system includes a scanner mounted upstream of said cutting element for reading indicia on said sheet web, said scanner producing signals in response to said indicia for deactivating said cutter system and forcing said accumulator to eject a set.

10. An asynchronous method of controlling a sheet-web cutter in an in-line system which comprises a cutter which cuts a moving sheet web having indicia thereon into individual sheets and an accumulator means which receives the individual sheets from the sheet-web cutter, collects them to form a group, and processes the sheets of the group, said method comprising the steps of:

transporting the sheet web past said cutter, cutting individual sheets therefrom with said cutter, and transporting said individually-cut sheets from said cutter to said accumulator means;

sensing when said cutter has cut the last sheet of a firstly-cut group of sheets to be collected by said accumulator and, in response thereto, transporting said web an amount corresponding to a first sheet of a secondly-cut group of sheets past said cutter, thereafter inhibiting further transportation and cutting of the first sheet of the secondly-cut group by said cutter until a further processing step is performed on the sheets of the firstly-cut group of sheets; and monitoring said firstly-cut group of sheets, and in response to the sensing of said further processing step being performed on them cutting said first sheet of said secondly-cut group with said cutter.

11. A method as in claim 10 wherein the further processing step performed on said individual sheets of said firstly-cut group by said accumulator means is to collect them into a pile and eject the thusly collected pile.

* * * * *